US006793297B2

(12) United States Patent
Johnson et al.

(10) Patent No.: US 6,793,297 B2
(45) Date of Patent: Sep. 21, 2004

(54) MEDAL DISPLAY CASE

(76) Inventors: E. Scott Johnson, 1115 S. Linwood Ave., Baltimore, MD (US) 21224; William B. Johnson, 14010 Notley Rd., Silver Spring, MD (US) 20904

( * ) Notice: Subject to any disclaimer, the term of this patent is extended or adjusted under 35 U.S.C. 154(b) by 0 days.

(21) Appl. No.: 10/093,955

(22) Filed: Mar. 7, 2002

(65) Prior Publication Data

US 2002/0145365 A1 Oct. 10, 2002

Related U.S. Application Data

(60) Provisional application No. 60/274,432, filed on Mar. 9, 2001.

(51) Int. Cl.[7] ..... A47F 3/00
(52) U.S. Cl. ..... 312/114; 312/117
(58) Field of Search ..... 312/114, 117, 312/128; 211/85.2; 248/303

(56) References Cited

U.S. PATENT DOCUMENTS 134,898 A * 1/1873 Klotz
623,835 A * 4/1899 Schanz
2,084,006 A * 6/1937 Sawin ..... 34/21
3,635,335 A * 1/1972 Kramer ..... 206/0.82
D250,157 S * 11/1978 Kelly ..... D6/172
4,244,303 A * 1/1981 Kurasik ..... 109/23
5,118,171 A * 6/1992 Ortiz ..... 312/114
5,390,437 A * 2/1995 Pearson ..... 40/661
5,479,733 A * 1/1996 Kusina ..... 40/155
5,671,849 A * 9/1997 Bacon ..... 211/13
5,690,402 A * 11/1997 Koppe ..... 312/128
D403,535 S * 1/1999 Wilbert ..... D6/470
D430,755 S * 9/2000 Simmons ..... D6/470
6,328,171 B1 * 12/2001 Coppel ..... 211/85.2
D465,945 S * 11/2002 Smith ..... D6/457

* cited by examiner

*Primary Examiner*—Leslie A. Braun
*Assistant Examiner*—Steven Marsh
(74) *Attorney, Agent, or Firm*—Law Offices of Royal W. Craig

(57) ABSTRACT

A decorative and practical framed showcase for pendant medals comprising a slotted display panel positioned between a primary back panel and a transparent viewing pane. The showcase attractively displays pendant type awards. The display panel comprises a slot or series of slots arranged uniformly in rows. The ribbon portion of an award is inserted into a slot in the display panel, and is pulled through to the back of the panel. The medal and a part of the ribbon remain visible from the front of the display panel. Retainers attached to the rear surface of the display panel secure the excess length of ribbon out of view and hold the medal suspended in place on the front side of the display panel. The showcase further comprises an integral means for secure attachment and simple removal to and from a wall.

12 Claims, 4 Drawing Sheets

MEDAL DISPLAY CASE

CROSS-REFERENCE TO RELATED APPLICATIONS

The present application derives priority from U.S. Provisional Application No. 60/274,432 for "PENDANT DISPLAY CASE"; filed Mar. 9, 2001; Inventors: Johnson, E. Scott; Johnson, William B.

BACKGROUND OF THE INVENTION

1. Field of the Invention

The present invention relates to showcases and, more particularly, to a decorative framed showcase used for displaying pendants and ribboned medal awards.

2. Description of the Background

Awards are frequently given to commemorate achievement in athletic competition, extra-curricular activities, or service to an organization. A pendant award is a combination medal and ribbon which allows the award to be placed around the neck of the recipient in the manner of a necklace. Olympic medals are a familiar example of pendant style awards.

Displaying such pendant awards, however, proves difficult. The long ribbon takes a disproportionate amount of space when fully extended and detracts from the ornamentation and script on the medal itself. Folding the ribbon proves clumsy, and the bulky folded ribbon likewise detracts from the medal. Prior displays of pendant medals include simple tie racks and shadow boxes, which have been shown to be impractical. Pendant medals hanging on a tie rack display the entire length of ribbon with the medal, distracting from the medal itself and causing the medals to sway and obscure one another from view. A shadow box, on the other hand, can practically only display one or two medals, so multiple shadow boxes are needed for several medals and each box takes up a significant amount of space.

In light of the foregoing, it would be of great advantage to create an improved showcase with a means for neatly displaying an individual or collection of pendant awards with only a portion of the ribbon in view.

SUMMARY OF THE INVENTION

It is, therefore, an object of the present invention to neatly display an individual or collection of pendant awards in a frame enclosure protected behind a transparent front pane, the pendant awards being suspended by a decorative display panel 10, and with the bulk of the ribbons being concealed behind the decorative display panel 10 and enclosed by a solid back panel.

It is another object to present a display case comprising a decorative display panel 10 having a slot or plurality of slots positioned at regular intervals into which the ribbon of a pendant award is partially inserted.

It is yet another object to secure the excess portion of said ribbon to the backside of the decorative display panel 10.

It is still further an object to provide a means for mounting the showcase on a wall.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

With reference to the drawings, the present invention is a showcase 2 for displaying for attractively displaying pendant type awards.

Figure 1:
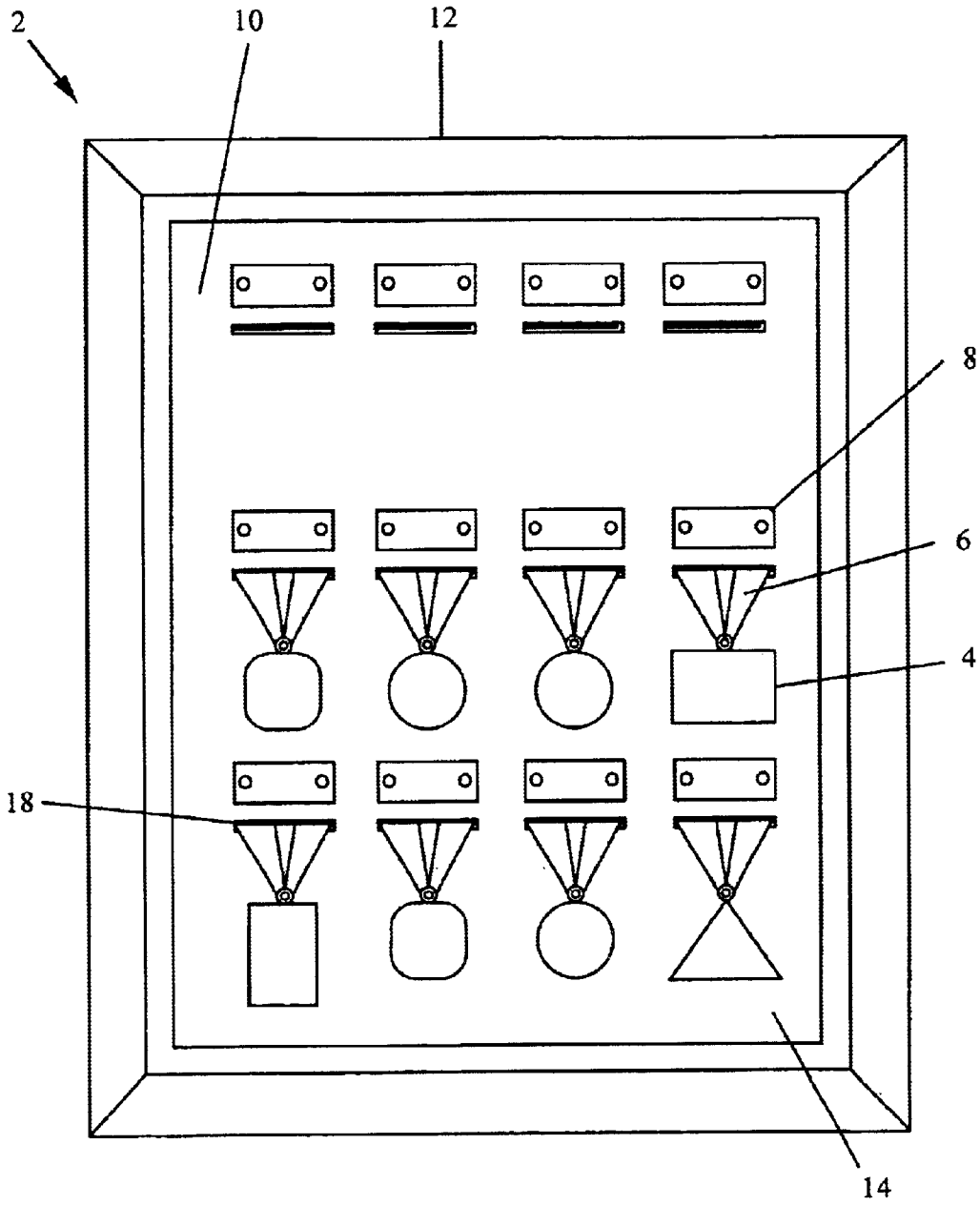
FIG. 1 is a front perspective view of a pendant showcase according to the present invention.

FIG. 1 is a front perspective view of the showcase 2. The showcase 2 generally includes a display enclosure defined by a viewing pane 14 seated within a frame 12, a primary back panel 30 attached to the rear of the frame 12, ad an enclosed display area visible through the viewing pane 14. In addition, a display panel 10 is secured within the showcase 2 between the viewing pane 14 and back panel 30, the display panel 10 including one or more slots 18 there through for passing the excess length of ribbon of pendant medals 4 mounted on the front side. Retainers 24*a*, 24*b* are mounted on the backside of the display panel 10 for securing the loose end of the excess ribbon. This way, pendant medals 4 are suspended by their attached ribbons 6 in an orderly alignment across a decorative display panel 10, and only a portion of the ribbons 6 remain visible in front of display panel 10. If desired, an engraved plaque 8 may be affixed to the display panel 10 above or below the visible portion of each pendant medal 4 to provide information about the nature and circumstances of the award. The plaques 8 may be attached directly to the display panel 10 by screws or other known means, and display panel 10 serves as a back-drop for the arrangement.

Display panel 10 is a flat rectangular sheet having a front face and a rear face, and may be formed of uniform particle-board composition having a standard thickness of approximately ⅛". Display panel 10 may alternately be made of foamboard, plywood, or any other lightweight and inexpensive material. The front face of display panel 10 is preferably covered with a decorative fabric material, such as velvet, or may be painted in a variety of colors. The illustrated material is a solid dark color to contrast with the vibrant colors of the ribbons 6.

Figure 2:
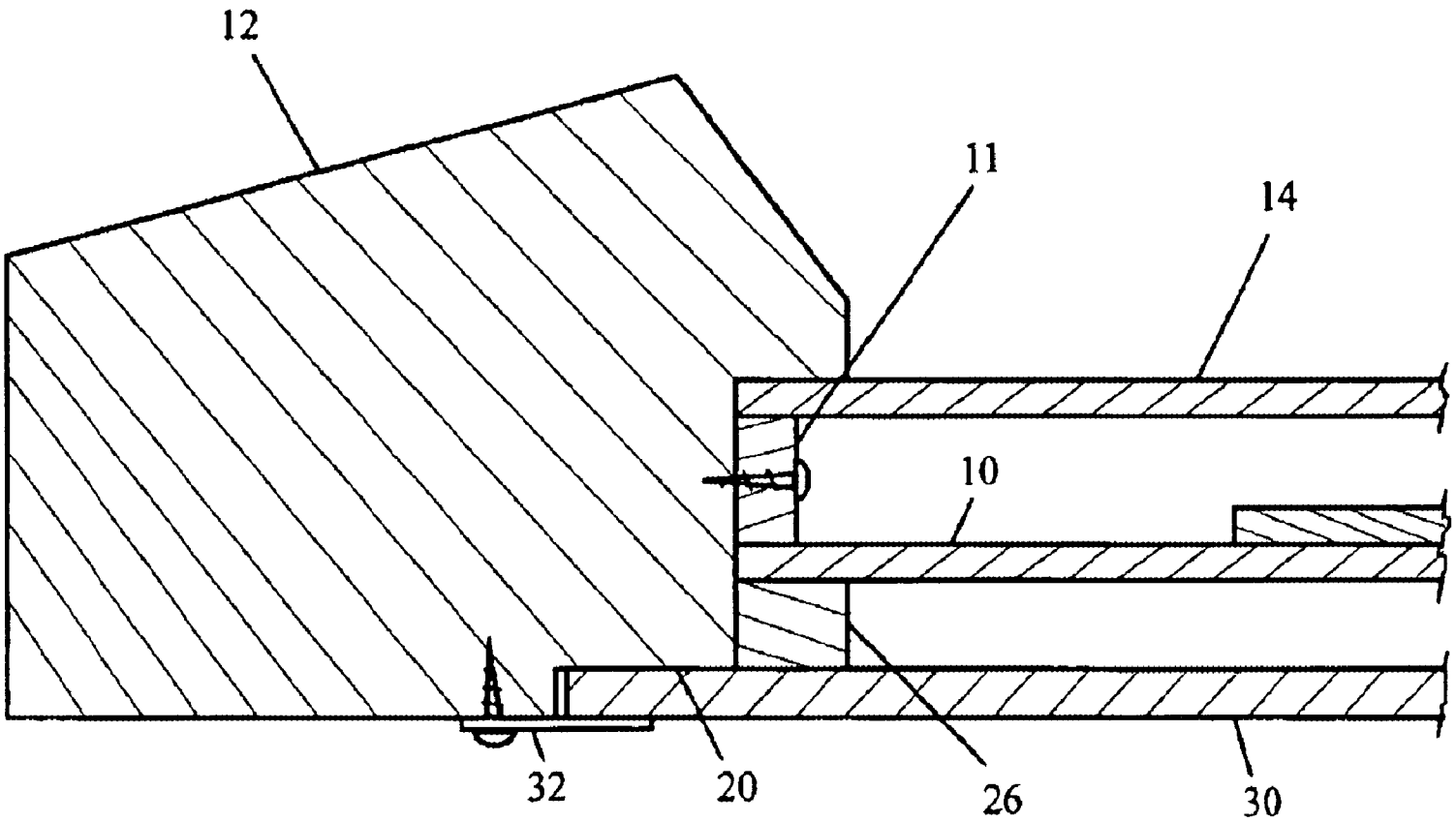
FIG. 2 is a partial cross-sectional view of the pendant showcase.
Figure 3:
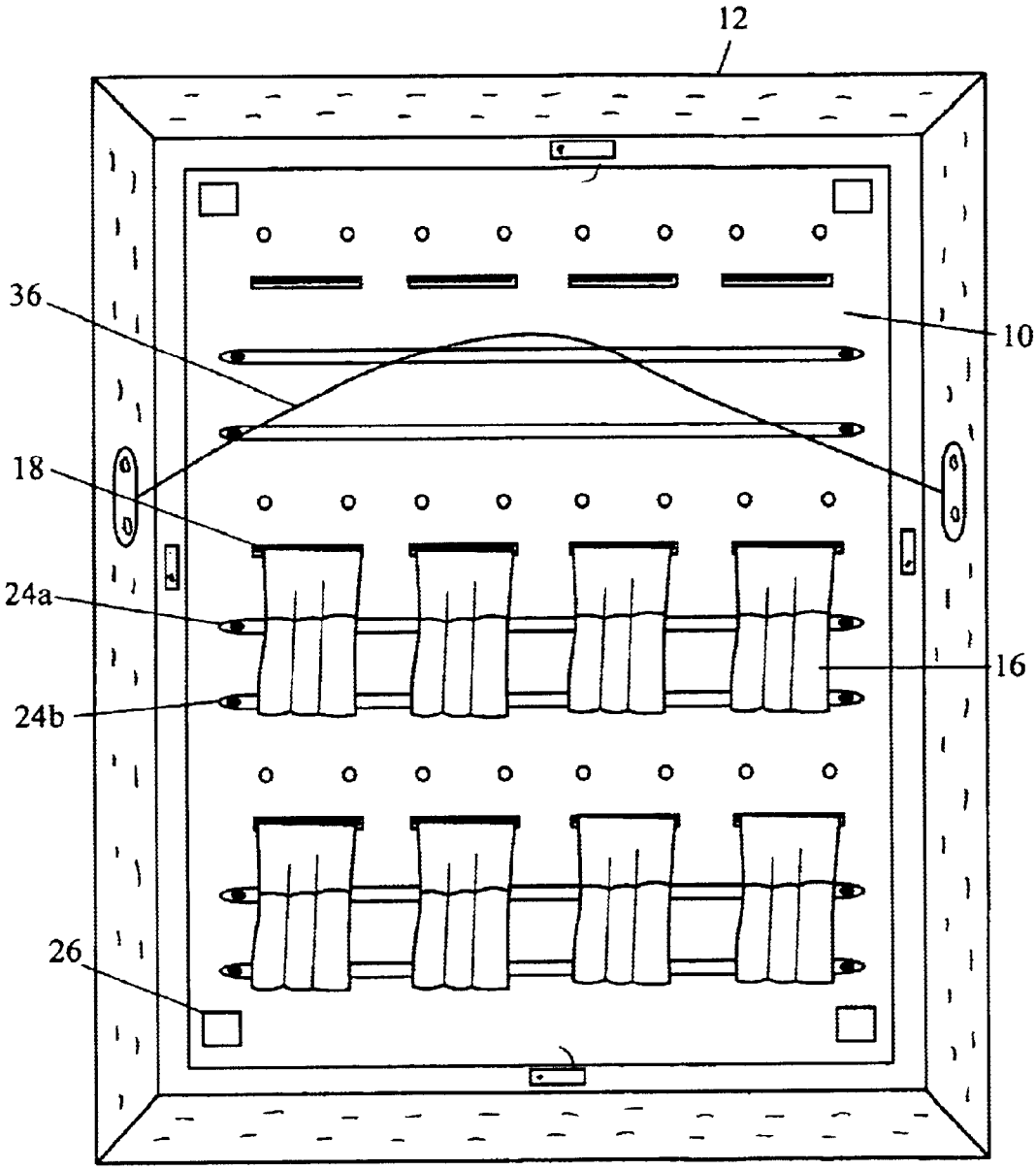
FIG. 3 is a rear perspective view of the showcase of the present invention with the back panel removed.

The display panel 10 is seated inside a surrounding frame 12 that supports display panel 10 on top, bottom and sides. Frame 12 may be constructed as a deep wooden frame including four 45 degree mitred wooden segments joined at their terminal edges. As shown in FIG. 3, the mitred wooden segments include an inwardly-directed lip, which, when the segments are joined, define a recess 20 along the inside border dimensioned to receive and seat a transparent pane 14 inserted therein. The frame segments may be attached in a known manner by wood screws and/or wood glue. The transparent pane 14 is preferably of glass or plexiglass and comprises a square or rectangular shape conforming to the shape of frame 12. In the illustrated embodiment, pane 14 is approximately ⅛" thick. Pane 14 is inserted first into frame 12, and then the display panel 10 is inserted and seated in the surrounding frame 12 such that pane 14 is positioned in front of display panel 10 to protect the awards displayed within the showcase. Small spacers 11 (as shown in FIG. 2) inserted behind pane 14 along the perimeter of frame 12 maintain a desired degree of clearance between display panel 10, and secures pane 14 in place within frame 12.

Figure 4:
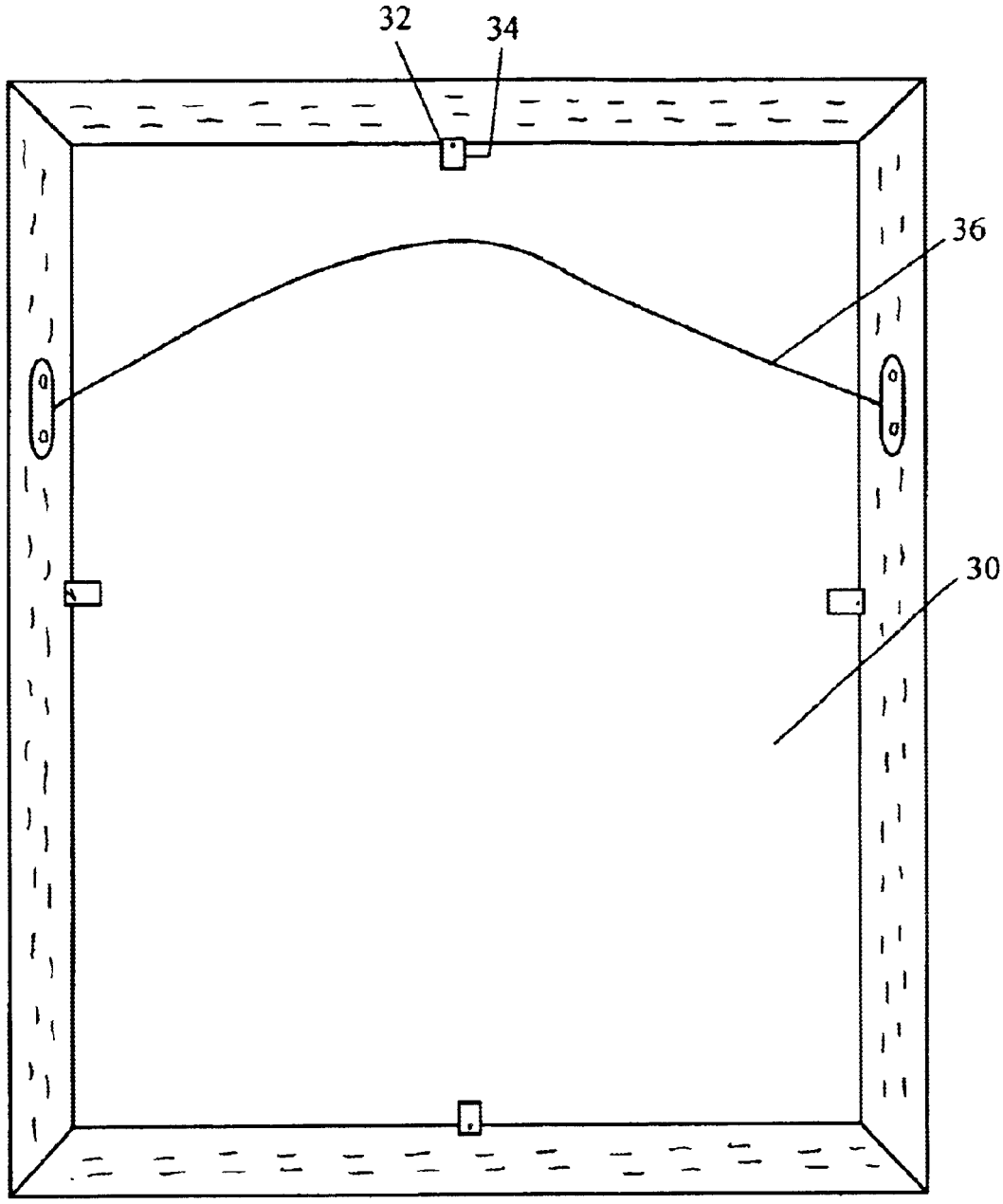
FIG. 4 is a rear perspective view of the showcase of the present invention showing the installed back panel and hanging means attached thereto.

A primary back panel 30 is then inserted and seated in the surrounding frame 12 behind display panel 10 as shown in FIG. 4 (display panel 10 is sandwiched between viewing pane 14 and primary back panel 30). Back panel 30 comprises a flat rectangular sheet having a front surface (obscured in FIG. 4) and a rear surface, the entirety of the panel likewise being of a uniform particle-board composition and of a thickness of approximately ⅛". Back panel 30 may alternately be made of cardboard, plywood, or any other lightweight and inexpensive material. Back panel 30 is hidden when the showcase is displayed, and is present merely to provide a rear closure for the obscured portions of the ribbons 6 and other internal elements of the showcase.

A plurality of clips 32 are positioned each at the mid-point of each side of frame 12 to secure back panel 30 in place within the recess 20 in the back side of frame 12. Clips 32 are of metal or plastic construction and comprise a screw, brad or post anchored at one end to the frame 12, and a pivoting arm34 attached at the opposite end for catching and securing the back panel within frame 12. Clips 32 pivot about the point of attachment, which permits arms 34 to be rotated into place over the edge of back panel 30.

A conventional hanger assembly 36 such as a wire or string is attached at two points to the rear of frame 12 in a known manner. Wire or string 36 is of a sufficiently sturdy gauge to support the weight of the fully assembled pendant showcase and its contents when mounted on a wall.

FIG. 3 is a rear perspective view of the showcase as in FIG. 1 with back panel 30 removed to reveal the construction of display panel 10 (evident from the rear face thereof). Narrow horizontal slots 18 are cut into display panel 10 forming a series of parallel rows. In the illustrated embodiment, slots 18 are approximately 2" long and ⅛" wide, and are laterally separated by approximately 1" of uncut panel. Each row of slots 18 is vertically spaced approximately 7" apart. This permits the excess lengths of ribbon 16 (which are to be hidden from view) to be inserted through slots 18 from the front of display panel 10.

The excess length of each ribbon 16 is secured to the back of display panel 10 by retainers 24*a* and 24*b*, the retainers being attached to the rear face of display panel 10 approximately 2" and 4", respectively, beneath each row of slots 18. Retainers 24*a* and 24*b* preferably comprise a length of elastic material approximately ½" wide and spanning the width of the rear face of the display panel 10 from side to side. Staples or similar retaining means are used to attach retainers 24*a* and 24*b* to display panel 10. The excess ribbons 16 are extended through slot 18 and are secured in place by wrapping the ribbon around retainers 24*a* and 24*b*. Alternatively, retainers 24*a* and 24*b* may comprise spring metal clips attached beneath each slot 18. In this manner, only medals 4 and a portion of ribbons 6 are visible from the front of the showcase display as shown in FIG. 1, and the bulk of the excess ribbons 16 are neatly wound inside of the showcase and are obscured therein.

As before, spacer blocks 26 are preferably mounted one in each corner and at the midpoint of the sides of the rear face of display panel 10. Blocks 26 comprise wooden cubes which extend outwardly from the rear face of display panel 10, and provide a surface against which the edges 20 of back panel 30 (shown in FIG. 4) rest.

In the above-described configuration, medals can be easily added or removed from the display simply by removing the back panel 30 secured in place by pivoting clips 32 and accessing the display showcase from behind. To gain optional forward access to the display panel 10, a slot (not shown) may be formed in the frame 12 to allow the viewing pane 14 to pass through, thereby allowing slidable withdrawal of the pane 14. Alternatively, the frame 12 may be hinged to allow the pane 14 to be open frontally.

It should also be apparent that the above-described dimensions may vary, and the number and arrangement of slots 18 may change accordingly. The showcase 2 constructed in accordance with the above specifications allows pendant awards to be attractively displayed and mounted on a wall. Medals, neatly arranged in rows, dangle beneath a partially visible portion of their attached ribbons against a display panel. The excess ribbon 16 is hidden from view by inserting it into a slot 18 cut into the display panel 10. The retainers 24*a* and 24*b* on the rear face of the display panel 10 secure the excess length of ribbon 16 and anchor the weight of the medal. The engraved brass plaques 8 can be attached above or below each medal to describe the circumstances of the award.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

We claim:

1. A showcase for displaying one or more pendant medals, comprising:

a display case including a viewing pane seated within a frame, a display area visible through said viewing pane, and a back panel attached to the rear of said frame for enclosing said display area; and a display panel secured within said frame spaced apart from said viewing pane and said back panel to thereby define dual compartments in the display case, said display panel including at least one slot there through for passing excess ribbon of a pendant medal, and at least one corresponding retainer mounted on said display panel rearwardly of said viewing pane for securing said excess ribbon when said pendant medal is attached to the front of said display panel.

2. The showcase for displaying one or more pendant medals according to claim 1, wherein said slot through said display panel is a horizontal slot.

3. The showcase for displaying one or more pendant medals according to claim 2, wherein said display panel further comprises a plurality of horizontal slots there through.

4. The showcase for displaying one or more pendant medals according to claim 3, wherein said plurality of horizontal slots are uniformly spaced.

5. The showcase for displaying one or more pendant medals according to claim 4, wherein said display panel further comprises a decorative covering conforming to said slots.

6. The showcase for displaying one or more pendant medals according to claim 4, wherein said display panel further comprises a plurality of retainers each attached beneath a corresponding row of slots.

7. The showcase for displaying one or more pendant medals according to claim 5, wherein said retainers each comprises a horizontal member running parallel beneath a row of slots for wrapping said excess ribbon thereabout.

8. The showcase for displaying one or more pendant medals according to claim 5, further comprising a hanger securely attached at two points to the display case, thereby enabling said display case to be hung on a wall for purpose of display.

9. A showcase for displaying one or more pendant medals, comprising:

a recessed frame;

a back panel attached to the rear of said frame;

a transparent viewing pane inserted into and seated within the recess of said frame;

a display panel secured within said frame spaced apart from said viewing pane and said back panel defining a dual compartment display case, said display panel having a plurality of horizontal slots therein; and a plurality of retainers attached rearwardly of said display panel for securing excess ribbons of the pendant medals;

whereby a portion of the ribbon and the medal of said pendant medals may be displayed forwardly of said display panel and the excess ribbon housed and concealed by insertion through one of said horizontal slots and securing by said retainers.

10. The showcase according to claim 9, wherein said slotted display panel has an exposed frontal surface bearing a slot or plurality of uniformly spaced slots and a fabric cover.

11. The showcase according to claim 10, wherein said slotted display panel has a concealed rear surface bearing a retainer or plurality of retainers attached in a parallel arrangement beneath.

12. The showcase according to claim 11, further comprising a hanger securely attached at two points to the rear border of said frame, thereby enabling said showcase to be hung on a wall for purpose of display.

* * * * *